US009818380B2

(12) United States Patent
Luttwak

(10) Patent No.: US 9,818,380 B2
(45) Date of Patent: Nov. 14, 2017

(54) METHOD FOR MAKING LIGHT AND STIFF PANELS AND STRUCTURES USING NATURAL FIBER COMPOSITES

(71) Applicant: Joseph E. Luttwak, San Francisco, CA (US)

(72) Inventor: Joseph E. Luttwak, San Francisco, CA (US)

( * ) Notice: Subject to any disclaimer, the term of this patent is extended or adjusted under 35 U.S.C. 154(b) by 128 days.

(21) Appl. No.: 14/546,518

(22) Filed: Nov. 18, 2014

(65) Prior Publication Data

US 2015/0135930 A1 May 21, 2015

Related U.S. Application Data

(60) Provisional application No. 61/905,752, filed on Nov. 18, 2013.

(51) Int. Cl.
*G10D 3/04* (2006.01)
*G10D 1/00* (2006.01)
*G10D 3/02* (2006.01)

(52) U.S. Cl.
CPC ..... *G10D 3/04* (2013.01); *G10D 1/005* (2013.01); *G10D 3/02* (2013.01)

(58) Field of Classification Search
CPC .. G10D 1/08; G10D 1/02; G10D 3/00; G10D 1/085
USPC ..... 84/267, 290, 291
See application file for complete search history.

(56) References Cited

U.S. PATENT DOCUMENTS 3,477,330 A * 11/1969 Bert ..... G10C 3/06 84/193
5,918,930 A * 7/1999 Kawai ..... A47C 7/74 297/180.1
2008/0110318 A1* 5/2008 Fox ..... G10D 3/06 84/267
2015/0101473 A1* 4/2015 Seal ..... G10D 1/08 84/291

* cited by examiner

*Primary Examiner* — Kimberly Lockett
(74) *Attorney, Agent, or Firm* — Kang S. Lim

(57) ABSTRACT

Method for making light and stiff panels and structures using natural fiber composites. An improved composite material utilized in musical instruments. Bio-based industrial fiber such as flax, cellulose, hemp, bamboo, and jute combined with a core material such as foam, aramid honeycomb, carbon fiber or balsa wood, and a resin, serves as a replacement to traditional tone wood. In another embodiment, the bio-based composite has no core material but simply layers of fabric with resin. Another embodiment finds layers of the woven bio-composite as the core between outside layers of carbon fiber or aramid. In the case of a string instrument, bio-composites can be used to make a substantially hollow unitary body, neck and head as well as soundboard. Another usage is for the bracing material of the soundboard. In fact in its various forms, bio-composite can effectively replace all the old growth wood currently used.

19 Claims, 9 Drawing Sheets

METHOD FOR MAKING LIGHT AND STIFF PANELS AND STRUCTURES USING NATURAL FIBER COMPOSITES

CROSS REFERENCE TO RELATED APPLICATIONS

This non-provisional application is a continuation-in-part and claims the benefit of provisional application No. 61/905,752, filed Nov. 18, 2013, of the same title, which application is incorporated herein in its entirety by this reference.

BACKGROUND

The present invention relates to string instruments. Stringed instruments traditionally have been constructed of wood, but also have been fabricated from plastics, molded composite materials, and combinations of such materials. As shown in FIG. 1, a conventional stringed instrument typically includes a body 10, a neck 12, a head 14 (sometimes called a "headstock"), a soundboard 16, a fingerboard 18 (sometimes called a "fretboard"), strings 20, a bridge 22 and a sound hole 24. In acoustic stringed instruments the interior of body 10 is hollow, and forms a resonant cavity, often called a "sound chamber." In acoustic stringed instruments, the vibration of strings 20 is transmitted through bridge 22 to the body via soundboard 16. In turn, the vibration of soundboard 16 vibrates air inside the sound chamber, and produces the sound that is projected from sound hole 24.

Acoustic string instruments are traditionally made of wood. As known to one skilled in the art, the material choice used to make soundboards are of particular import as this component accounts for the vast majority of the resonance and quality of sound produced. The back and sides, often tropical hardwoods such as Rosewood and mahogany and are known to impact the instrument sound as well. The wood commonly used for soundboards exhibit specific mechanical properties that result in tonal qualities desired by players and listeners.

Throughout history, certain species of wood have been known to possess good qualities for use as string instrument soundboards. The instrument's success has traditionally relied upon the skills of a luthier (string instrument maker) to utilize these preferred species and select plates that display superior resonating properties. In recent times, researchers have determined the attributes that impart these wood species and specific plates made thereof namely with high specific modulus and low internal friction in the grain direction produce the best soundboards [3]. Ono et al.

Further demonstrated that the stiffness in the cross-grain direction is also an important factor [3]. The shear modulus has been shown to govern the behavior in the high frequency range [1]. Thus all of these dynamic properties must be taken into consideration when developing an engineered material to replace wood.

Other important factors are the density, thickness and strength of the material. It is critical not to exceed the areal density of a typical spruce soundboard in order to maintain the radiation efficiency of the instrument. A spruce soundboard of about 2.5 mm thickness typically has an areal density ranging from approximately 1.1 to 1.5 kg/m Old-growth soft woods such as spruce, cedar and to a significantly lesser degree cypress and redwood, are all sought after for soundboard use. After centuries of experimentation, these woods have become the ideal choice because of a few factors: high stiffness-to-weight (tensile modulus) along the grain, very low mass and density. This attributes together form a highly resonant sound-board which transforms string energy into sound most efficiently. The relatively low density imparts a certain lossy quality to the sound by absorbing higher frequencies. This is characterized as a 'woody' sound—an abstract concept which speaks to the utility of this invention.

These aforementioned values were used as design guidelines to develop suitable ply sequences for the bio-composite sandwich panel. The material must also be strong enough to withstand the tension of the strings. Spruce has a bending strength ranging from approximately 80-130 MPa for 100 mm by 20 mm by 3 mm specimens.

The disadvantages of producing sound boards with these soft woods include sensitivity to humidity changes, fragility, scarcity, quality inconsistency, and public concern over diminishing resources from ever shrinking old-growth forests (see Sitka spruce).

In the last few decades, composites have emerged as a viable alternative material and it is clear why. An acoustic guitar that goes from a temperature and humidity controlled environment to a dry and hot climate typical of the American Southwest is likely to have the top crack as a result of the humidity delta. Composites such as epoxy/carbon fiber laminates in contrast are humidity insensitive.

From a structural perspective, wood instruments are fragile. Sound boards in particular are delicate because of the use of a thin plank of ¼" or thinner soft wood which is easy cracked particularly along the grain. In the case of acoustic guitars, a complicated sub-assembly called bracing is adhered to the bottom surface of the top for structural support in part to overcome these shortcomings.

Another problem with wood is the high quality old growth wood used to make the prized examples is being increasingly scarce and Federally regulated under the Endangered Species Act (CITES). Taylor Guitars (San Diego, Calif.) for instance has acquired the majority of the world's available and legal ebony. Old growth Sitka Spruce (*Picea sitchensis*), used by many manufacturers of high quality acoustic instruments from guitars to pianos for soundboards, is a rapidly depleting and found only in Alaska's Tongass National Forest. These trees live to 700 years and beyond, making them very difficult to replenish. Renewable alternative to replace such trees are becoming increasingly necessary accordingly the large manufacture of acoustic instruments, Martin, has turned to Phenolic composite material as a reliable albeit sonically inferior alternative for their entry level instruments. This illustrated by Martin's use of Sitka Spruce for their more expensive instruments.

As a result of these durability issues, a few companies have introduced composite instruments made of humidity insensitive material such as carbon fiber and epoxy. This manner of construction has a number of design advantages including enabling one-piece construction and bi-directional stiff tops. These aforementioned are of particular import as they also add to the durability and environmental stability of the instrument. Specifically the bi-directional stiff top allows for a reduction in bracing which is the sub-structure typically bonded to the top of an inherently uni-directional wood top to give it additionally stiffness and strength particularly across the grain.

The problem with carbon fiber composites is tonal quality which is described as tinny and metallic as compared to tone woods such as spruce due to significantly less damping (see graph). Carbon fiber epoxy composites are high in density as compared to spruce which translates to less damping. This is a qualitative difference that results from the players and listeners accustomed to the specific sound of a wooden instrument. It is possible to reduce the density of a carbon composite by adding a core material, which is a sandwich structure, such as made with a honeycomb and a few layers of fabric on either side. The problem with that method is commercially available fabrics and core structures result in a composite that is too stiff. For an acoustic ukulele application for instance, this creates tone lacking in bass response and 'warmth'.

Bio-based composites are lower in density as compared with carbon fiber. For instance flax linen, a preferred bio-based reinforcement fabric is typically around 1.45 g/cm$^3$ while carbon fiber is typically 1.75 g/cm$^3$. Bio-based reinforcements exhibit roughly 20% of the stiffness or tensile modulus of carbon fiber, but combined with a core are a viable solution to the problem of excessive stiffness plus density. By utilizing a core of approximately 1 mm-10 mm thick, depending on the application, the stiffness increases exponentially by the power of approximately three whenever the thickness doubles. This enables bio-based composites to achieve even greater stiffness-to-weight ratios than a solid carbon fiber laminate which does not employ sandwich construction and with lower mass and density. The desired stiffness can be attained by varying the thickness of the core and to a lesser degree the quantity of layers, type, and configuration of the fabrics. For a ukulele application for instance, a 0.5 mm thick 3×3 k 190 gsm carbon fiber top can be replaced by 2×50 gsm uni-directional 'flaxtape' linen fabrics manufactured by Lineo of France and positioned at 0 degrees and 90 degrees along with a 1.7 mm Rohacell core made by Evonik of Germany. This bio-composite laminate has both increased tensile modulus and lower mass than the carbon fiber top described previously. In contrast, a sandwich structure made with unidirectional carbon fiber fabric of similar weight would have too great a stiffness to produce a pleasing acoustic tone. Further a conventional layup such as 3 k plain weave carbon fiber, nomex, 3 k plain weave carbon fiber is easily produced in a compression molding or autoclave process, but both too heavy and too stiff for a soundboard.

Dupont Kevlar also known as Aramid is another option with lower density than carbon fiber which has favorable wood-like characteristics. It does have its own host of problems well known to those familiar with the art including difficulty of adhesion to core layers, a 'plastic' aesthetic and difficulty to cut 'cleanly' and without fraying. Because it is a consistent material, it lacks the tonal complexity that comes from an organic, naturally derived material such as a bio-composite. Sandwich construction with a relatively thin laminate of fabric and resin is still much more consistent than wood enabling accurate control units for research and development purposes.

It is therefore apparent that an urgent need exists for light and stiff natural composite panels. This improved musical instrument material and structure improves the responsiveness of the sound board; the durability and stability of an instrument; as well as quality consistency in production.

SUMMARY

To achieve the foregoing and in accordance with the present invention, stringed instruments substantially made from bio-composite materials and methods for manufacturing thereof are provided. Such instruments are sturdy, highly humidity resistant, playable and without the many disadvantages of traditional wooden instruments. The quality of the sound produced by the soundboard approximates wood soundboard materials more closely than carbon fiber composites.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well-known process steps and/or structures have not been described in detail in order to not unnecessarily obscure the present invention. The features and advantages of the present invention may be better understood with reference to the drawings and discussions that follow.

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute and/or sequential terms, such as, for example, "will," "will not," "shall," "shall not," "must," "must not," "first," "initially," "next," "subsequently," "before," "after," "lastly," and "finally," are not meant to limit the scope of the present invention as the embodiments disclosed herein are merely exemplary.

Figure 1:
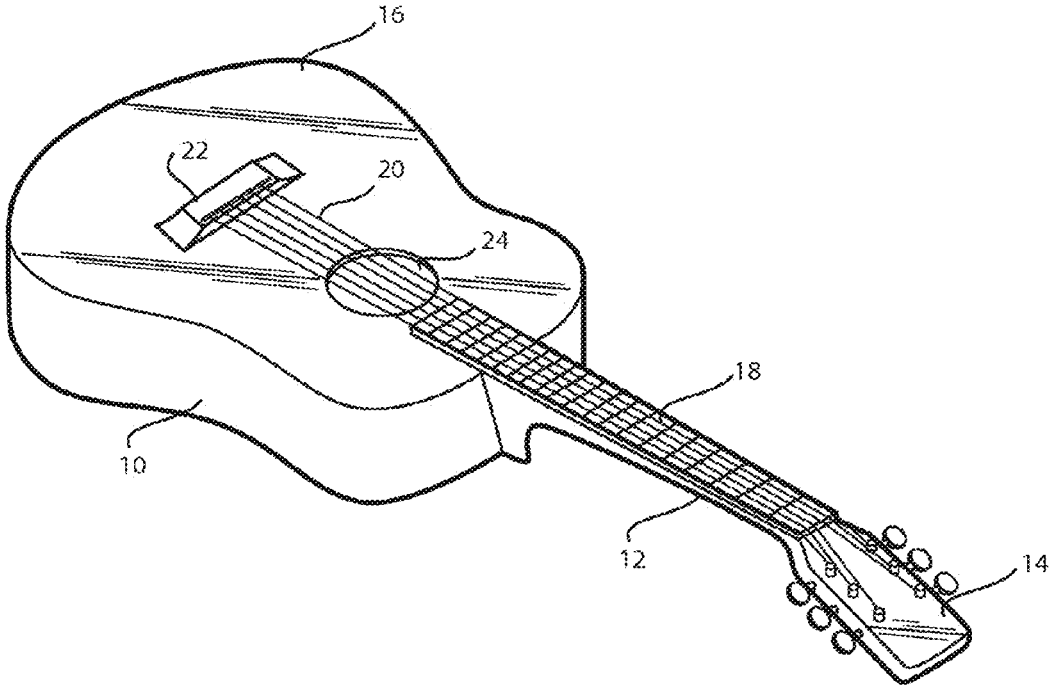
FIG. 1 (PRIOR ART)
FIG. 1 is perspective view of a conventional stringed instrument.
Figure 2:
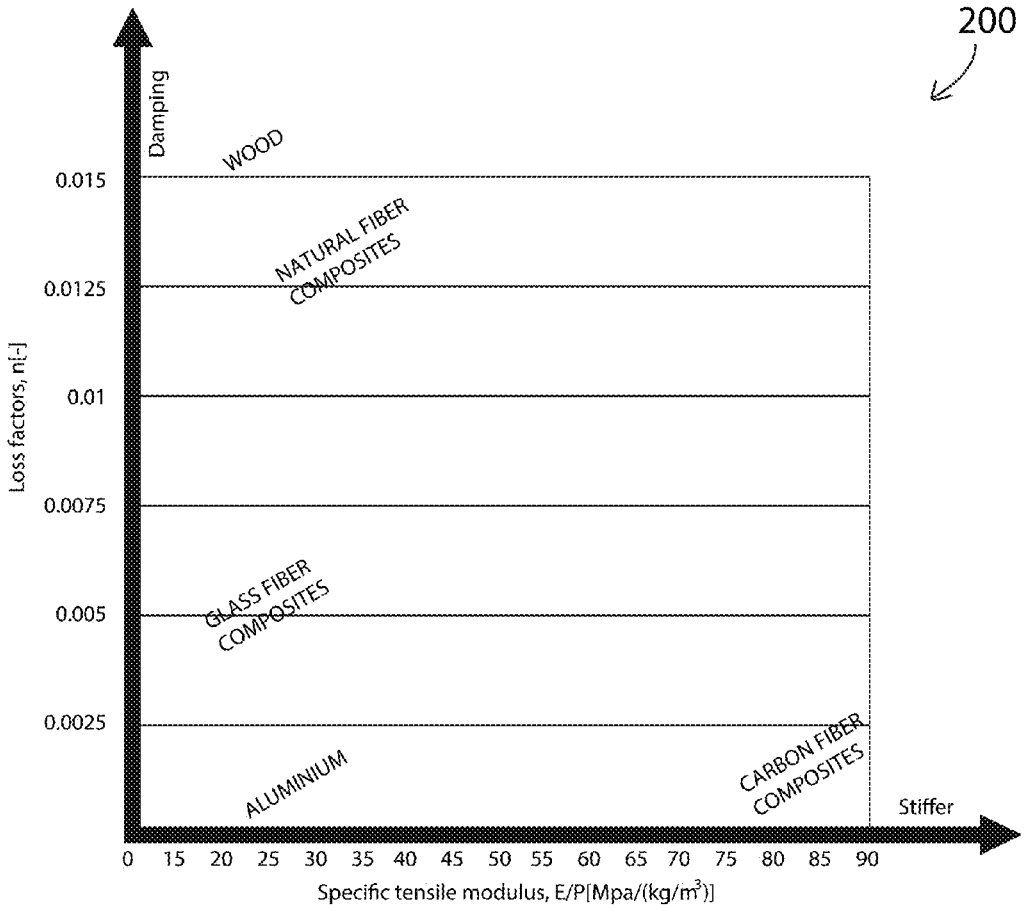
FIG. 2 is a chart showing dampening on the x axis and stiffness on the y axis.
Figure 3:
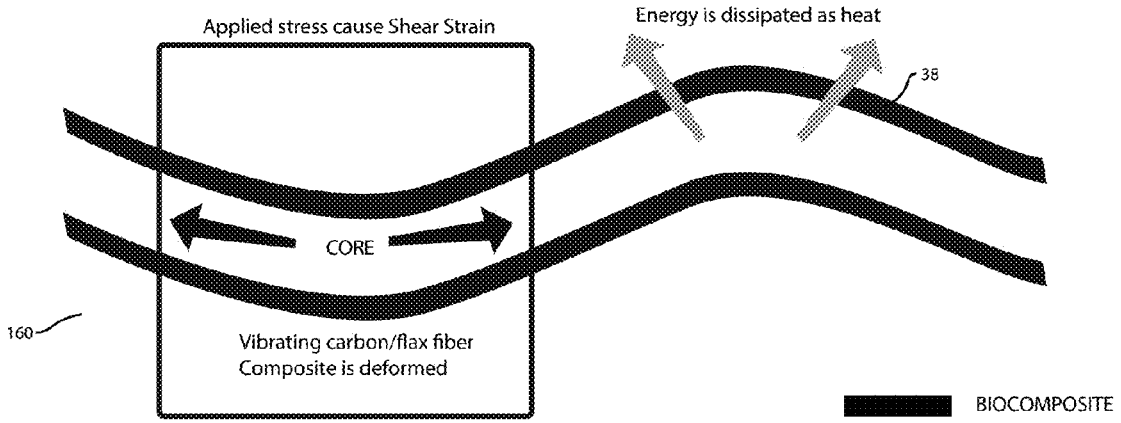
FIG. 3 is an illustration showing the effect of string vibration on the soundboard of one embodiment of the present invention.

Referring to FIG. 2, this chart illustrates notably, the high dampening qualities of both wood and natural fiber composites on one dimension and the relatively high tensile modulus of natural fiber composites as compared with wood. Carbon fiber composites have relatively low dampening and exceptionally high tensile modulus. Combined with a core material such as middle layer 530, the thickness becomes too thin to be practical in manufacturing FIG. 3, is a graphical representation of vibration damping and illustrates the effect of string vibration on soundboards of some embodiments of the present invention.

Figure 4:
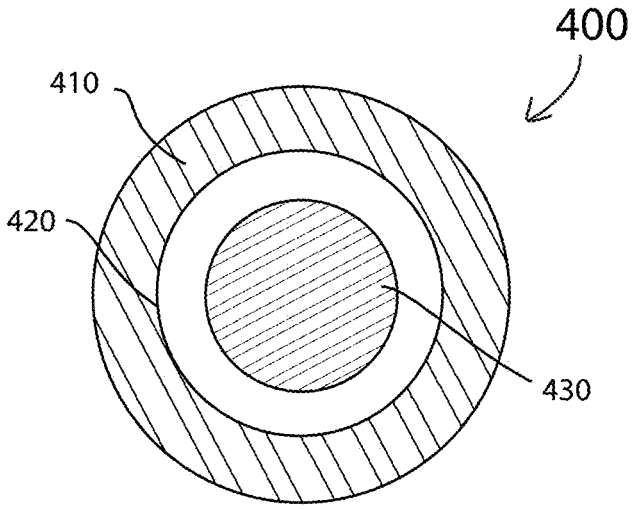
FIG. 4 is a cross-sectional view of a cylindrical structure in accordance with some embodiments of this invention.

Referring to the cross-sectional view of FIG. 4, in some embodiments, a cylindrical structure such as tube 400 includes top layer 410, middle layer 420, and bottom layer 430. Top layer 410 is made of one or more layers of uni-directional or bi-directional continuous natural fiber such as cotton, flax, cellulose, sisal, ramie, hemp, and Jute, approximately 0.05 mm-0.3 mm approximately 50-250 gsm. Middle layer 420 is made of a core material such as foam, balsa, cork, birch plywood, cardboard, laminate bulker, aluminum and composite honeycomb such as Nomex manufactured by DuPont of Wilmington, Del. These cores can range in thickness from approximately 2-10 mm. Tube 400 is useful for construction the soundboard of string instruments such as guitars, ukuleles, and violins. Bottom layer 430 is made of a least one layer of uni-directional and/or bi-directional bast-based fiber such as flax, hemp, and Jute, approximately 0.1 mm-0.5 mm approximately 50-250 gsm. Tube 400 can also be used to construct the shells of acoustic instruments such as drums. Other suitable natural fiber materials include recycled paper products, recycled wood products, and other suitable bio materials known to one skilled in the art.

Figure 5:
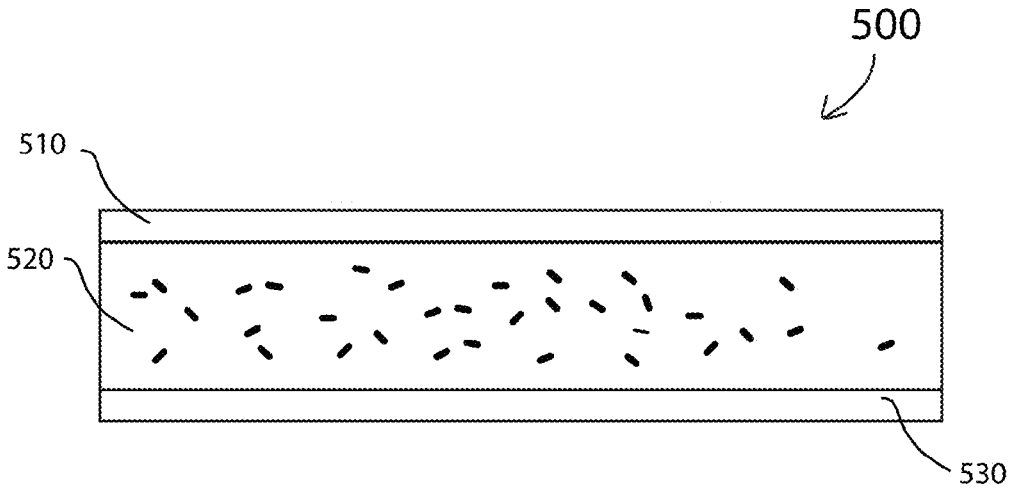
FIG. 5 is a cross-sectional view of an exemplary soundboard in accordance with some embodiments of this invention.

Referring to the cross-sectional view of FIG. 5, an exemplary embodiment of a soundboard includes a sandwich 500 includes top layer 510, middle layer 520, and bottom layer 530. Top layer 510 is made of one or more layers of uni-directional or bi-directional continuous natural fiber such as flax, cellulose, sisal, ramie, hemp, and Jute, approximately 0.05 mm-0.3 mm approximately 50-250 gsm. Middle layer 520 is made of a core material such as foam, balsa, cork, birch plywood, aluminum and composite honeycomb in a range of thickness approximately 1.5 mm-5 mm. Sandwich 500 is useful for construction the soundboard of string instruments such as guitars, ukuleles, and violins. Bottom layer 530 is made of a least one layer of uni-directional and/or bi-directional bast-based fiber such as flax, hemp, kenaf, sisal, ramie and Jute, approximately 0.1 mm-0.5 mm approximately 50-250 gsm. Sandwich 500 can also be used to construct the shells of acoustic instruments such as drums. In some embodiments, top layer 510 includes two uni-directional layers each about 50-250 gsm in thickness.

In some embodiments, top layer and bottom layer 510 and 530 can be made of preimpregnated composite with suitable adhesive such as epoxy, bio-based epoxy, polyester, vinylester, hemicellulose, sap, sugar resin and phenolic and/or any other natural and/or synthetic compounds known.

In another embodiment, top layer and bottom layer 510 and 530 can be made using suitable liquid adhesive applied directly to the dry fabric by brush injection and/or vacuum infused.

In yet another embodiment, top layer and bottom layer 510 and 530 can be made using a sheet molding compound and/or film adhesive applied directly to the dry fabric. It is also possible for a top layer 510 to be prepreg and a bottom layer 530 to be a dry fabric layer with suitable adhesive.

Top layer and bottom layer 510 and 530 can be adhered with the middle layer(s) 520 under compression at approximately 10-100 psi using for example a vacuum, compression press, autoclave and/or continuous lamination as well processing at a temperature range of approximately 70-250 degrees Fahrenheit ("F").

Middle core layer 520, as is known to people familiar in the art of composites, adds exponential specific tensile modulus proportional to thickness.

Smaller Instruments and/or Lower String Tension

In some smaller instruments such as ukuleles and classical guitars with lower tension nylon strings, thinner middle layer 520 may be used with a range in thickness of approximately 1 mm-2 mm and top layer and bottom layer 510 and 530 with a range of thickness from approximately 0.05 mm-0.2 mm.

Figure 6:
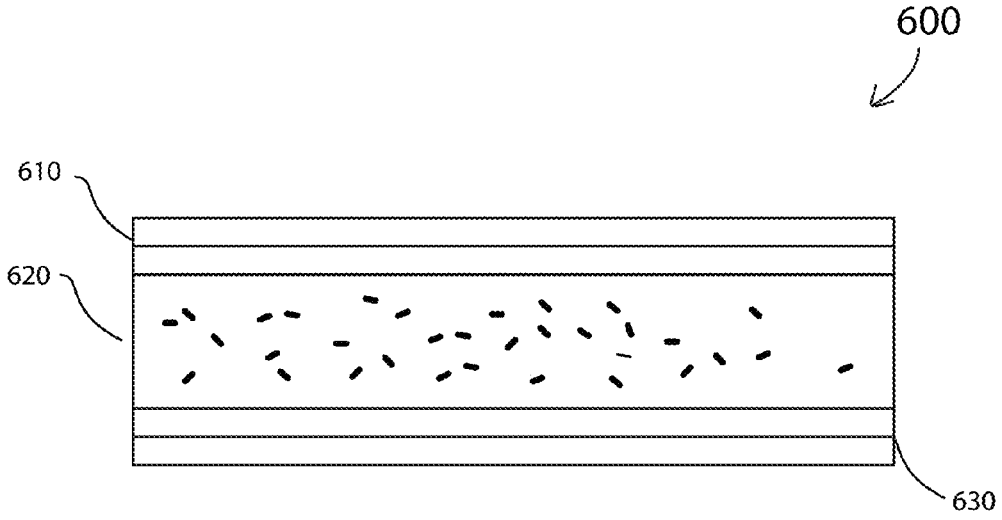
FIG. 6 is a cross-sectional view of an alternative exemplary soundboard in accordance with other embodiments of this invention.

Referring to the cross-sectional view FIG. 6, in yet another embodiment of the invention, a soundboard includes a sandwich 600 includes top layer 610, middle layer 620, and bottom layer 630. Top layer 610 is made of one or more layers of uni-directional, bi-directional, and/or discontinuous and/or continuous natural fiber such as flax, cellulose, sisal, ramie, hemp, and Jute, approximately 0.05 mm-0.3 mm approximately 50-250 gsm laminated with one or more layers of uni-directional and/or bi-directional aramid, Innegra, carbon fiber, or fiberglass, approximately 0.05 mm-0.3 mm approximately 50-250 gsm. Middle layer 620 is made of a core material such as foam, balsa, cork, birch plywood, aluminum and composite honeycomb in a range of thickness approximately 1 mm-7 mm. Sandwich 600 is useful for construction the soundboard of musical instruments such as guitars, ukuleles, pianos and violins. Bottom layer 630 is made of one layer of uni-directional and/or bi-directional bast-based fiber such as flax, hemp, and Jute, approximately 0.1 mm-0.5 mm approximately 50-250 gsm and one or more layers of uni-directional and/or bi-directional aramid, Innegra, carbon fiber, or fiberglass, approximately 0.05 mm-0.3 mm approximately 50-250 gsm. Sandwich 600 can also be used to construct the shells of acoustic instruments such as drums.

In some embodiments, the soundboard includes a hybrid weave with natural fibers and carbon fiber woven at about 0-90 degrees to each other. It is also possible for the hybrid weave to include natural fibers and/or synthetic fibers arranged in substantially randomized directions.

In some embodiments, top layer and bottom layer 610 and 630 can be made of preimpregnated composite with suitable adhesive such as epoxy, bio-based epoxy, polyester, vinylester, hemicellulose, sugar resin and phenolic.

In other embodiments, top layer and bottom layer 610 and 630 can be made using suitable liquid adhesive applied directly to the dry fabric by brush injection and/or vacuum infused.

In yet another embodiment, top layer and bottom layer 610 and 630 can be made using a sheet molding compound and/or film adhesive applied directly to the dry fabric. It is also possible for a top layer 610 to be prepreg and a bottom layer 630 to be a dry fabric layer with suitable adhesive.

Top layer and bottom layer 610 and 630 can be adhered with the middle layer(s) 620 under compression at approximately 10-100 psi using for example a vacuum, compression press, autoclave and/or continuous lamination as well processing at a temperature range of approximately 70-250 F.

Middle core layer 620, as is known to people familiar in the art of composites, adds exponential specific tensile modulus proportional to thickness.

Figure 7:
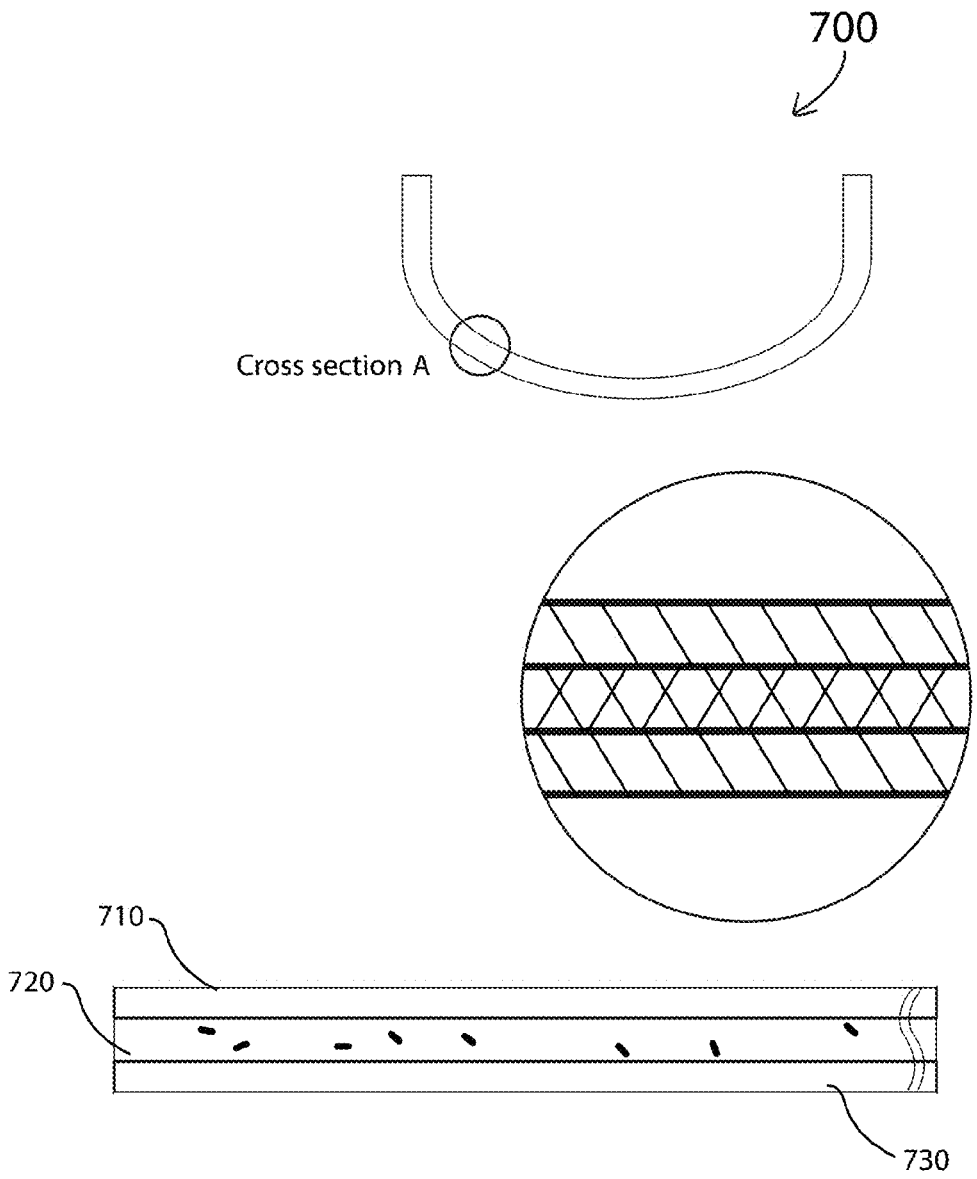
FIG. 7 is a cross-sectional view of an exemplary string instrument body in accordance with some embodiments of this invention.

Referring to FIG. 7 which includes cross-sectional views of an exemplary string instrument of the present invention, cross section of body 700 includes top layer 710, middle layer 720, and bottom layer 730. Top layer 710 is of one or more layers of uni-directional or bi-directional bast-based fiber such as such as flax, cellulose, sisal, ramie, hemp, and Jute, approximately 0.05 mm-0.3 mm approximately 50-250 gsm. Middle layer 720 is made of a core material such as foam, cork, balsa, honeycomb in a range of thickness approximately 0.3 mm-7 mm. Middle layer 720 can also be made of one of more layers of biocomposite Cross-section of body 700 is useful for construction of the body of string instruments such as guitars, ukuleles, and violins. Bottom layer 730 is made of a least one layer of uni-directional or bi-directional bast-based fiber such as flax, hemp, and Jute, approximately 0.3 mm-2 mm approximately 50-250 gsm.

In some embodiments, top layer and bottom layer 710 and 730 can be made of pre-impregnated composite with suitable adhesive such as epoxy, bio-based epoxy, polyester, vinylester, hemicellulose, sugar resin and phenolic.

In another embodiment, top layer and bottom layer 710 and 730 can be made of liquid resin applied directly to the dry fabric brush injected or infused.

It is also possible for a top layer 710 to be prepreg and a bottom layer 730 to be a dry fabric layer with suitable adhesive.

Top layer and bottom layer 710 and 730 are combined with middle layer(s) 720 under compression at approximately 10-100 psi using for example a vacuum, compression press, and/or continuous lamination as well processing at a temperature range of approximately 70-250 f.

Figure 8:
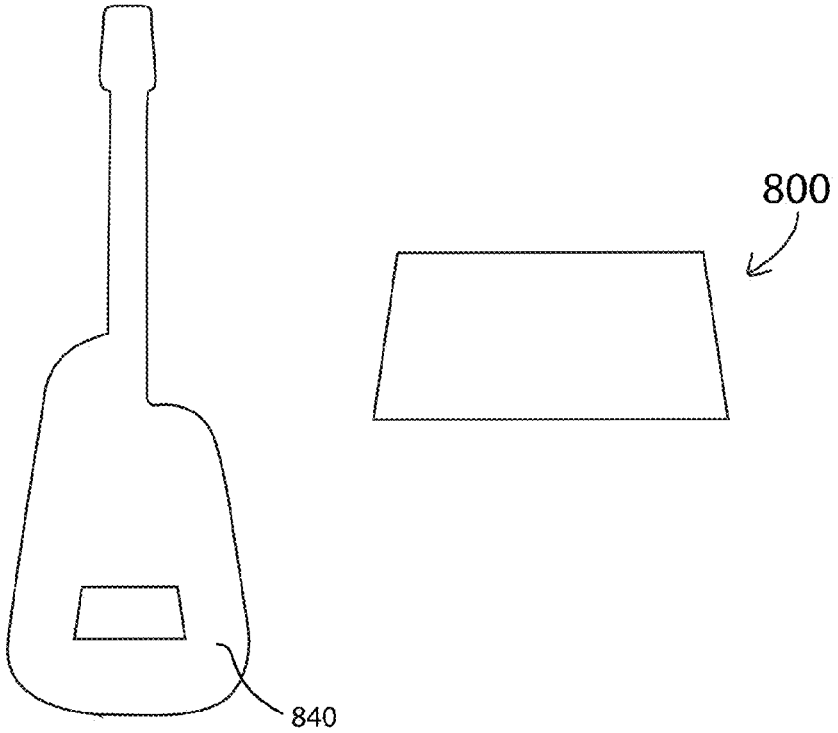
FIG. 8 includes cross-sectional views of an exemplary bridge plate in accordance with some embodiments of this invention.
Figure 8:
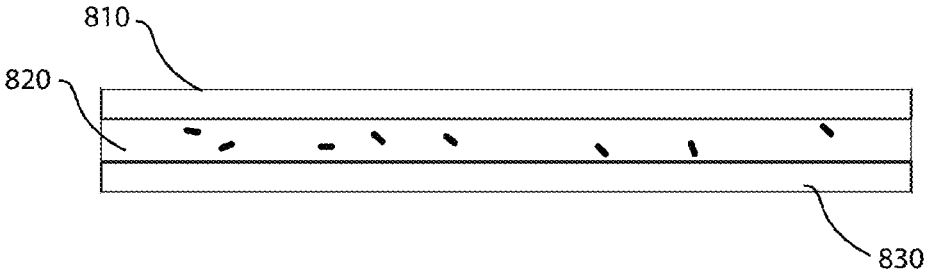

Referring now to FIG. 8, which includes cross-sectional views of an exemplary bridge plate in accordance with some embodiments of this invention, the bridge plate includes the top layer 810 and bottom layer 830 are comprised one or more layers of unidirectional and/or bi-directional bio-based approximately 40-300 gsm fabric. Wherein middle layer 820 is comprised of core material from approximately 1-10 mm thick.

In another embodiment, the top and bottom layers are comprised one or more layers of uni-directional and/or bi-directional aramid and one or more layers of uni-directional and/or bi-directional bio-based fabric.

Similarly, another embodiment, the top and bottom layers are comprised one or more layers of uni-directional and/or bi-directional carbon fiber and one or more layers of uni-directional and/or bi-directional bio-based fabric.

The bridge plate 800 can be mounted to the underside of the soundboard 840 where the strings are mounted via the bridge.

This arrangement adds stiffness to the structure proportional to the geometry and thickness of the bridge plate.

The density of the bridge plate has impact on the timber and warmth of the acoustic tone. Biocomposite enables very low mass bridge plates and thus warm eq.

Figure 9:
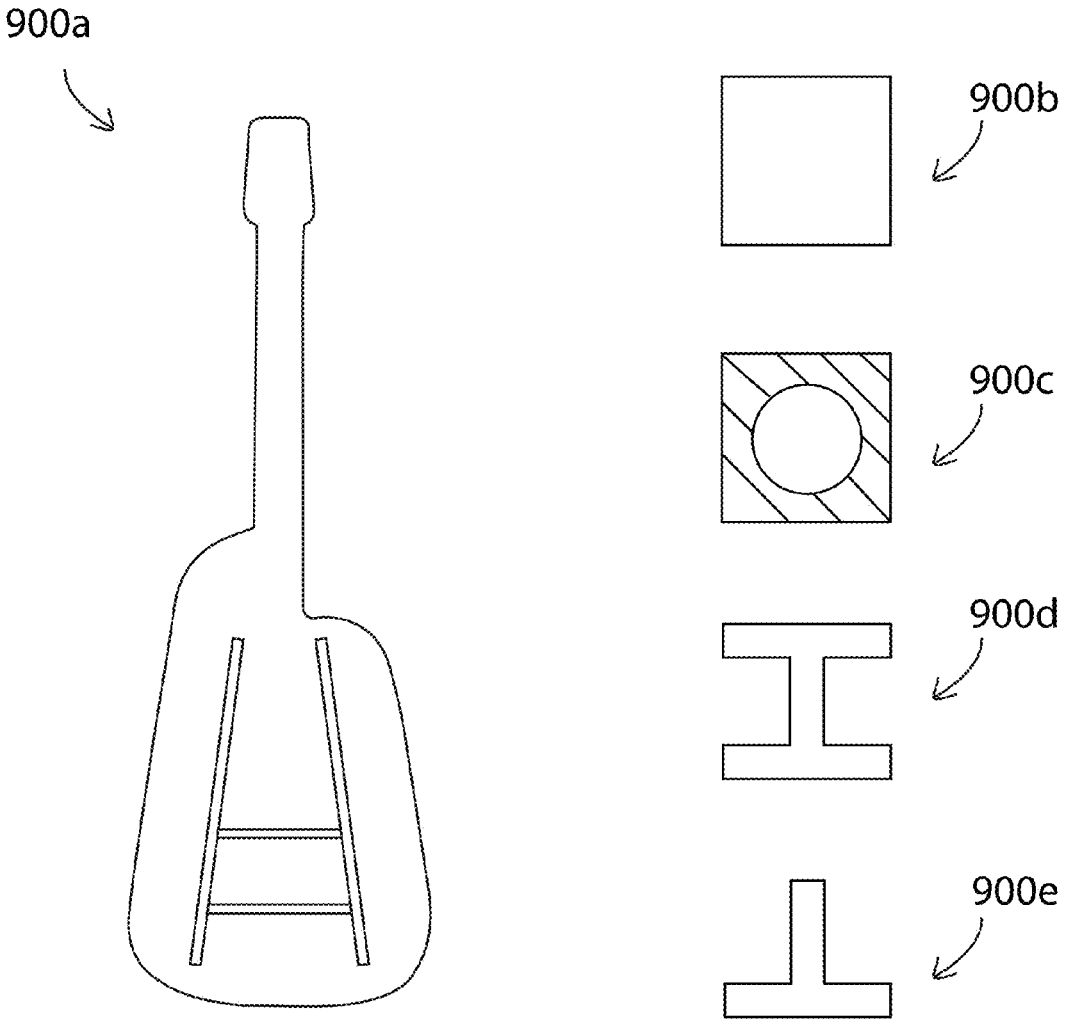
FIG. 9 includes cross-sectional views of alternative exemplary bracing profiles in accordance with various embodiments of this invention.

FIG. 9 includes cross-sectional views of alternative exemplary bracing profiles for additional embodiments of the present invention. Referring to bracing assembly 900*a*, two longitudinally oriented biocomposite tubes and/or rods and/or molded and/or tube/rod subassemblies running the length of the sound box and/or entire length of body including the neck and head. Also shown, are two tubes and/or rods and/or molded components and/or tube/rod subassemblies latitudinal oriented. In other embodiments bracing assembly 900*a* utilizes a single to a multitude of biocomposite tubes and/or rods and/or molded bracing components and/or tube/rod subassemblies.

Bracing profile cross section 900*b*, can be a rod made of one or more layers of biocomposite approximately 100 gsm-500 gsm and ranging in size from approximately 2-10 mm square. In another embodiment the rod is rectangular wherein length is approximately 2 mm-8 mm and width approximately 3-12 mm. Other bracing profiles would also effective including Trianglar, T-bracket, L-bracket, half-moon, elliptical, polygonal, or any other suitable profile designs known to one skilled in the mechanical arts. In addition, these bracing profiles may be perforated to further increase their strength to weight ratio. Perforations may be molded, punched, drilled, laser-cut, or otherwise created using methods known to one skilled in the art.

Bracing profile cross section 900*c*, is a tube made of one or more layers of biocomposite approximately 100 gsm-500 gsm and ranging in size from approximately 2-10 mm square. In another embodiment the tube is rectangular wherein length is approximately 2 mm-8 mm and width approximately 3-12 mm.

Bracing profile cross section 900*d*, is a I-beam made of one or more layers of biocomposite approximately 100 gsm-500 gsm and ranging in size from approximately 2-12 mm.

Bracing profile cross section 900*e*, is a tube made of one or more layers of biocomposite approximately 100 gsm-500 gsm and ranging in size from approximately 2-10 mm square. In another embodiment the tube is rectangular wherein length is approximately 2 mm-8 mm and width approximately 3-12 mm.

In some embodiments, cross sections 900*a*-900*e* may be tapered wherein the outer edges are substantially thinner than the center. The taper distance ranges from approximately 0-50 mm.

There are various methods to manufacture these tubes, rods and assemblies including compression molding, wrap-rolling, bladder-molding, filament winding and pultrusion. In other embodiments the bracing can be molded as a substantially hollow 3D form. For example an x-brace for a steel string acoustic guitar—thereby eliminating joints, reducing weight and production complexity.

Bracing profiles as shown in 900*b*-900*c* and as oriented in assembly 900*a*, can add substantial stiffness to the structure depending on geometry and thickness.

While the above described structures and methods have been exemplified using the construction of stringed musical instruments, many of these structures and methods can be also used for the manufacture of other acoustical musical instruments such as drums. In addition, these structures and methods can also be adapted for manufacturing of other products such as furniture, hand tools, kitchen utensils and storage containers.

While this invention has been described in terms of several embodiments, there are alterations, modifications, permutations, and substitute equivalents, which fall within the scope of this invention. Although sub-section titles have been provided to aid in the description of the invention, these titles are merely illustrative and are not intended to limit the scope of the present invention.

It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A sound board useful in association with an acoustic musical instrument, the soundboard comprising:

at least one surface layer including a plurality of only unidirectional filaments made from a natural material and a resin matrix exterior, and wherein the at least one surface layer does not include any woven material; and a middle core layer.

2. The sound board of claim 1, wherein the middle core layer includes an aramid paper honeycomb core material.

3. A sound board useful in association with an acoustic musical instrument, the soundboard comprising:

at least one layer of hybrid material including a plurality of only unidirectional natural fiber filaments and synthetic filaments, and wherein the at least one layer does not include any woven material;

a resin matrix exterior; and a middle core material.

4. The sound board of claim 1, wherein the middle core layer includes a wood veneer core material.

5. The sound board of claim 3 and wherein the middle core layer includes a wood veneer material.

6. The sound board of claim 1, wherein filaments are continuous.

7. The sound board of claim 1, wherein the middle core layer includes a foam core material.

8. The sound board of claim 1, wherein the middle core layer includes an end-grain balsa core material.

9. A string instrument comprising:

an instrument body; and a sound board including:

at least one surface layer having a plurality of only unidirectional filaments made from a natural material and a resin matrix exterior, and wherein the at least one surface layer does not include any woven material; and a middle core layer.

10. The sound board of claim 1 further comprising a bracing support assembly including:

a support structure having a bio-composite material; and a resin matrix.

11. The sound board of claim 10 wherein the support structure has a substantially T-shaped cross-sectional profile, and wherein the bio-composite material includes at least one of a woven material and a uni-directional material.

12. The sound board of claim 10 wherein the support structure has a substantially square cross-sectional profile, and wherein the bio-composite material includes at least one of a woven material and a uni-directional material.

13. The sound board of claim 10 wherein the support structure has a substantially rectangular cross-sectional profile, and wherein the bio-composite material includes at least one of a woven material and a uni-directional material.

14. The sound board of claim 3 wherein the middle core layer includes an aramid paper honeycomb core material.

15. The soundboard of claim 3 wherein the middle core is a foam core material.

16. The string instrument of claim 9, wherein the middle core layer includes an aramid paper honeycomb core material.

17. The string instrument of claim 9, wherein the middle core layer includes a wood veneer core material.

18. The string instrument of claim 9, wherein the middle core layer includes a foam core material.

19. The string instrument of claim 9, wherein the middle core layer includes an end-grain balsa core material.

* * * * *